United States Patent [19]

Haneda et al.

[11] Patent Number: 5,073,801

[45] Date of Patent: Dec. 17, 1991

[54] COLOR IMAGE FORMING APPARATUS HAVING DIFFERENT EJECTION PARTS FOR DIFFERENT PAPER THICKNESS

[75] Inventors: Satoshi Haneda; Masakazu Fukuchi; Shunji Matsuo; Shizuo Morita, all of Hachioji, Japan

[73] Assignee: Konica Corporation, Tokyo, Japan

[21] Appl. No.: 558,768

[22] Filed: Jul. 26, 1990

[30] Foreign Application Priority Data

Aug. 9, 1989 [JP] Japan ..... 1-207244
Sep. 1, 1989 [JP] Japan ..... 1-228097

[51] Int. Cl.[5] ..... G03G 21/00

[52] U.S. Cl. ..... 355/311; 355/321; 355/326

[58] Field of Search ..... 355/285, 311, 321, 326, 355/327, 308, 309, 323, 212; 271/279, 298, 303

[56] References Cited

U.S. PATENT DOCUMENTS 4,652,110 3/1987 Sato et al. ..... 355/283 X
4,699,503 10/1987 Hyltoft ..... 355/319
4,868,608 9/1989 Allen, Jr. et al. ..... 355/326 X
4,920,382 4/1990 Mills et al. ..... 355/326 X
4,945,390 7/1990 Hasegawa et al. .

FOREIGN PATENT DOCUMENTS 0138274 6/1986 Japan ..... 355/311
0235853 10/1986 Japan .
0034180 2/1987 Japan .
0092171 4/1989 Japan .
0114872 5/1989 Japan ..... 355/321

*Primary Examiner*—A. T. Grimley
*Assistant Examiner*—Robert Beatty
*Attorney, Agent, or Firm*—Frishauf, Holtz, Goodman & Woodward

[57] ABSTRACT

A color image forming apparatus has a plurality of developing devices and an automatic paper feed unit and a manual paper feed unit, each paper feed unit having a paper feed cassette. The paper feed units are provided below a belt-shaped image retainer. Paper ejection ports are provided above the image retainer for ejecting transfer materials which are fed from a paper feed unit, one of the paper ejection ports being selected according to the thickness of the transfer material. A thermal fixing condition is varied according to the transfer material thickness.

8 Claims, 2 Drawing Sheets

COLOR IMAGE FORMING APPARATUS HAVING DIFFERENT EJECTION PARTS FOR DIFFERENT PAPER THICKNESS

BACKGROUND OF THE INVENTION:

1. Field of the Invention

This invention relates to a color image forming apparatus adapted to form a toner image on a belt-shaped image retainer by an electrophotographic system, to transfer the toner image on a transfer material and to obtain an object image.

2. Description of the Prior Art

Many methods and apparatuses for obtaining color images by using electrophotography have been proposed. As disclosed in, for example, Japanese Patent Laid-open No. 100770/1986, there is a method of obtaining a color copy by forming a latent image on a photosensitive drum serving as an image retainer in accordance with a color separation number of a document image, developing the latent image on the drum, transferring the resultant image onto a transfer drum every time the development of the latent image is completed to form a multi-color image on the transfer drum, and thereafter transferring the multi-color image onto a transfer material to obtain a color copy. An apparatus realizing this method needs to be provided with a large transfer drum where a one-frame image is transferred on the circumferential surface in addition to a photosensitive drum. Consequently, it is unavoidable that this apparatus has a large and complicated structure.

There is another method disclosed in, for example, Japanese Patent Laid-open No. 149972/1986, which comprises the steps of forming a latent image on a photosensitive drum in accordance with the color separation number of a document image, developing the latent image on the drum, and transferring the resultant image onto a transfer material every time the development of the latent image is completed, to obtain a multi-color copy. In this method, it is difficult to accurately superpose each of monochromatic images upon one another, so that a high-quality multi-color copy cannot be obtained.

There is also another method of obtaining a color image, which comprises the steps of repeating formation of a latent image on a photosensitive drum in accordance with the color separation number of a document image and development of the latent image with color toners, superposing color toner images upon one another on the photosensitive drum, and then transferring the resultant image onto a transfer material. The basic processes for formation of such a multi-color image are disclosed, for example, in Japanese Patent Laid-open Nos. 75850/1985, 76766/1985, 95456/1985, 95458/1985 and 158475/1985.

In a multi-color image forming apparatus for obtaining a color image by such an image superposing step, a plurality of developing devices storing different color toners therein are arranged around a photosensitive drum, and a latent image on this drum is developed by rotating the same drum generally a plurality of times to obtain a color image.

In addition to the photosensitive drum which has a photoconductive material applied or evaporated on the circumferential surface of the drum as described above, a belt-shaped image retainer which has a photoconductive material applied or attached to a flexible belt has also been proposed. Since the shape of a belt-shaped image retainer is determined by training the same around rollers including a driving roller, such an image retainer is an effective device for making a compact color image forming apparatus by utilizing the space advantageously. Since the photosensitive belt can be moved along a line of a small curvature, the imperfect separation of a transfer material can be prevented by utilizing a curved portion of a small-diameter roller in use.

In a color image forming apparatus using a photosensitive belt described above, the image forming means including a charging means, an exposure means, a plurality of developing devices and a cleaning means are provided where they faces mainly the lower portion of the outer circumferential surface of the photosensitive belt. These image forming means including the photosensitive belt are incorporated in a unit as a process cartridge and the unit is detachably housed independently in an apparatus body.

The transfer material with a color toner image transferred thereon is ejected, with its copied surface down, onto a receiving tray placed on the upper surface of the apparatus, and the apparatus can be installed in a small space.

It has been needed to use a color image forming apparatus of the type described above in which as a transfer material, thick transfer materials such as transparent sheets for OHP or postcards besides regular transfer paper can be used. When thick transfer material is bent along a surface of a large curvature, it would be curled stiffly, and creased so that the image thereon would be damaged. Therefore, it is necessary that the passage for the transfer paper has a small curvature. Accordingly, the radius of curvature of the passage in the discharge section extending toward the tray has to be set large. However, when this radius of curvature is set large, the leading end of the regular transfer paper turns inward during the ejection of the same, and it is not properly stacked on the tray.

In order to solve this problem, it is considered that a receiving tray for thick transfer material is provided on a separate portion of the apparatus so that the passage from the transfer paper entry section to the tray is formed on a straight line. However, in such an apparatus, necessarily the thick and thin transfer material are ejected separately to different portions of the apparatus, with the copied surfaces directed in different directions, i.e. up and down. Consequently, the size of the apparatus increases, and a wide space for installing the apparatus is required. Moreover, the operation of the apparatus becomes complicated.

When the transfer material of different thickness is used, the fixing of an image is not done perfectly due to different required quantities of heat, and the image may be offset fixed.

SUMMARY OF THE INVENTION

An object of the present invention is to provide a color image forming apparatus capable of solving these problems, using transfer paper of a large thickness in addition to regular transfer paper, fixing an image perfectly on any of these transfer papers, and ejecting the transfer paper and stacking the same on a single receiving tray, with the copied surfaces thereof facing in the same direction, without increasing the size of the apparatus.

The above object is achieved by a color image forming apparatus comprising an image forming means having two rollers arranged laterally, a belt-shaped image retainer which is trained around the two rollers and a plurality of developing means provided below the belt-shaped image retainer, and wherein a paper feed unit having a paper feed cassette is provided below the image forming means, paper ejection ports for ejecting transfer papers which are fed from the paper feed unit or paper manual feed portion and on which toner images are thermally fixed are provided at an upper position, one of the paper ejection ports being selected according to specifying the thickness of transfer material; the condition of thermal fixing is varied according to the transfer material thickness specifying operation; and the transfer materials ejected from the paper ejection ports selectively provided are all moved to and placed on the same ejection tray placed in an upper position.

The above object is achieved also by a color image forming apparatus comprising an image forming means having two rollers arranged laterally, a belt-shaped image retainer which is trained around the two rollers, and a plurality of developing means provided below the belt-shaped image retainer, and wherein an automatic paper feed unit having a detachable paper feed cassette and a manual paper feed unit are provided below the image forming means, paper ejection ports for ejecting transfer materials which are fed from the automatic paper feed unit or manual paper feed unit and on which toner images are thermally fixed are provided at an upper position, one of the paper ejection ports being selected according to specifying the thickness of transfer material; the condition of thermal fixing is varied according to the transfer material thickness specifying operation; and the transfer material ejected from the paper ejection ports selectively provided are all moved to and placed on the same ejection tray placed in an upper position.

The above and other objects as well as advantageous features of the invention will become apparent from the following description of the preferred embodiment taken in conjunction with the accompanying drawings.

DESCRIPTION OF THE PREFERRED EMBODIMENTS

First Embodiment

Figure 1:
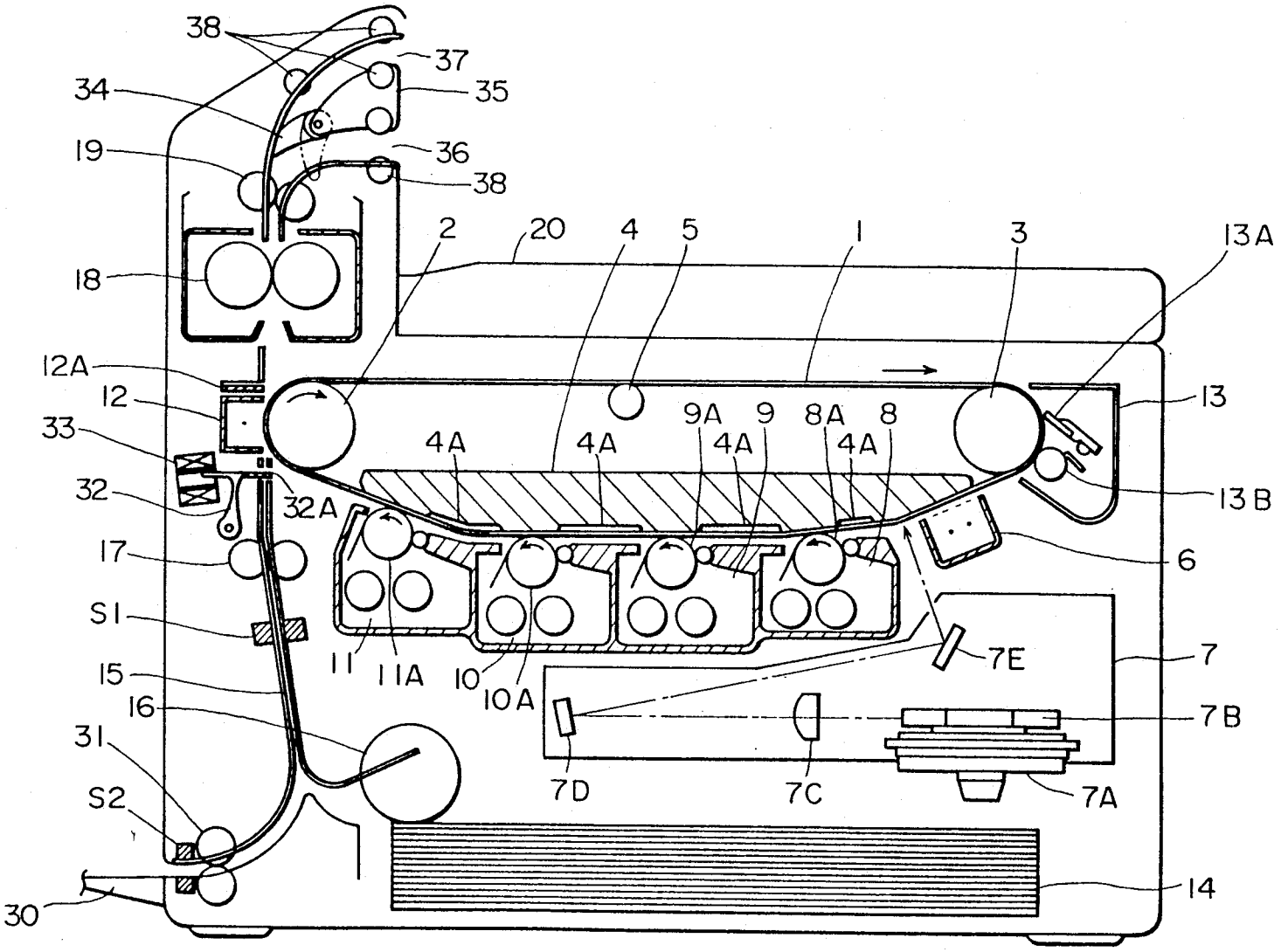
FIG. 1 is a sectional view showing the structure of a first embodiment of a color image forming apparatus according to the present invention.

Referring to FIG. 1, a reference numeral 1 denotes a flexible photosensitive belt constituting a belt-shaped image retainer, which is trained around rollers 2, 3 and turned clockwise by the driving force of the roller 2.

A reference numeral 4 denotes a guide member inscribing the photosensitive belt 1, which is tensed by an operation of an outwardly biased tension roller 5 to be brought into slidable contact at the inner circumferential surface thereof with the guide member 4. The guide member 4 is provided with recesses 4A to reduce the frictional resistance in the regions thereof which are not necessary for the formation of an image. These recesses 4A can, of course, be omitted when the frictional resistance is low. It is preferable to provide a low frictional resistance member treated with Teflon on the surface of either the photosensitive belt 1 or guide member 4, or to form the photosensitive belt 1 or guide member 4 of this low frictional resistance material, for the purpose of reducing the frictional resistance between these parts.

Accordingly, the photosensitive material on the outer circumferential surface of the photosensitive belt 1 can always keep a constant positional relation with respect to the surface of the guide member 4 even while the photosensitive belt 1 is turned, so that a stable image forming surface can be obtained.

A reference numeral 6 denotes a scorotron charger, a charging means, 7 a laser writing unit, an image exposing means, and 8 to 11 a plurality of developing devices, i.e. developing means containing developers of predetermined colors. These developing means are arranged facing the photosensitive belt 1. In order to keep a clearance between these developing devices and photosensitive belt 1, and not to obstruct the movement of the photosensitive belt 1, the developing devices contact the guide member 4 on the outer side of the photosensitive belt 1 through clearance retaining means.

In the laser writing unit 7, an optical system of a unitary combination of a light emitting element and a convergent light transmission member, besides the optical system shown in the drawing.

The developing devices 8, 9, 10 and 11 contain, for example, yellow, magenta, cyan and black developer respectively, and are provided with developing sleeves 8A, 9A, 10A and 11A which retain predetermined clearances between the developing devices and photosensitive belt 1, the developing devices having functions of turning a latent image on the photosensitive belt 1 into a visible image by a non-contact reversal developing method. This non-contact developing method is different from the contact developing method has an advantage that the movement of the photosensitive belt 1 is not interfered with.

A reference numeral 12 denotes a transfer device, 12A a charge eliminating bar, and 13 a cleaning device as a cleaning means. A blade 13A and a toner feeding roller 13B in this cleaning device are retained in the positions apart from the surface of the photosensitive belt 1 during the formation of an image, and they are pressed against the surface of the photosensitive belt 1 as shown in the drawing, only while a cleaning operation is carried out after the completion of the transferring of the image.

A reference numeral 14 denotes a paper feed cassette containing the ordinary transfer papers and which is provided in the lower portion of the apparatus so that it can be withdrawn leftward in the drawing, 15 a paper feed guide forming a passage for transporting papers, 16 a paper feed roller, 17 intermediate rollers rotating constantly during a copying operation, 20 an ejection tray provided on the upper portion of the apparatus, 30 manual paper insertion table provided at the lower portion of the apparatus so as to insert transfer paper manually therefrom, 31 feed rollers for manually inserted transfer paper, 32 a synchronizing shutter having a T-shaped cross section capable of being turned around a base end portion thereof, provided at one of the free end portions thereof with a plate type member 32A for stopping the transfer of the transfer paper, and at the other free end portion thereof with an iron core member, and normally urged by a spring (not shown) so that the plate type member 32A projects into a transfer passage and stops the transfer of the transfer paper, 33 a solenoid for attracting the iron core member to retract the synchronizing shutter 32 from the transfer passage in synchronism with the starting of an image forming process, 34 a cross-sectionally long triangular or comma-shaped change-over blade, 35 an island member provided with the change-over blade 34 so as to control the transfer passage, 36 an ordinary paper discharge port, 37 a thick paper discharge port, and 38 rollers for transferring the transfer paper smoothly, and reference symbols S1, S2 sensors consisting, for example, of photoelectric detectors for detecting the presence or absence of transfer paper in the transfer passage.

An automatic paper feed unit comprises the paper feed cassette 14, paper feed guide 15, paper feed roller 16 and sensor S1. The paper feed roller 16 is operated by a controller, which will be described later, in the apparatus body, in accordance with a signal from the sensor S1 when the transfer paper in the paper feed guide 15 runs out during an image forming process, to send out piece by piece the uppermost ordinary transfer paper in the paper feed cassette 14.

A manual paper feed unit comprises the manual paper insertion table 30, paper feed rollers 31, paper feed guide 15 and sensors S1, S2. When the front end portion of thick transfer paper is inserted slightly into the apparatus, it is detected by the sensor S2, and the operation of the paper feed roller 16 is stopped by a control unit which will be described later. When the absence of transfer paper in the paper feed guide 15 is ascertained by the sensor S1, the paper feed rollers 31 and operated to feed the inserted transfer paper.

The intermediate rollers 17 are frictionally driven, and the ordinary transfer paper or thick transfer paper fed into the paper feed guide 15 is further sent upward by the intermediate rollers 17. When the leading edge of the transfer paper is brought into contact with the synchronizing shutter 32, the movement of the transfer paper stops, and the intermediate rollers 17 slip so as to apply an excessive urging force on the transfer paper and to permit the paper to be in stand-by state. The synchronizing shutter 32 retracts owing to the energization of the solenoid 33 effected by an operation of the control unit, and the transfer paper starts moving.

A color image recording process by this color image forming apparatus is carried out as follows.

Figure 4:
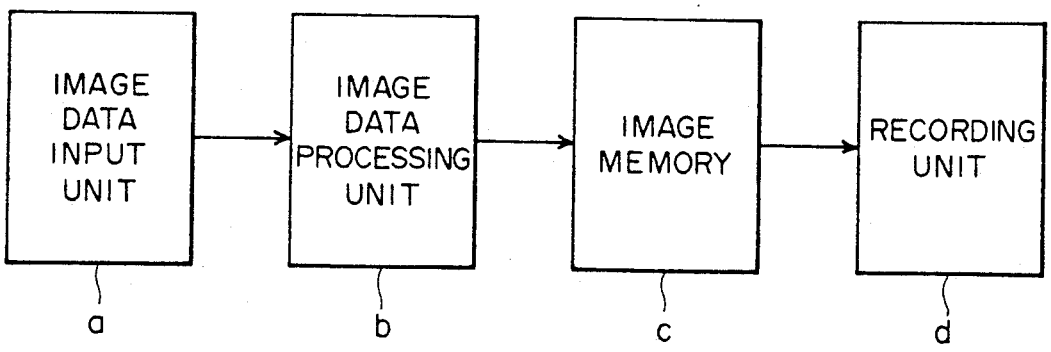
FIG. 4 is a block diagram showing an image forming system in the embodiment of FIG. 1.

The formation of a multi-color image by this embodiment is carried out in accordance with an image formation system shown in FIG. 4. Namely, the data obtained in a color image data input unit a in which an original image is scanned by an image pickup element are computed in an image data processor b having calculating function, to make image data to stored temporarily in an image memory c. The image data are then taken out in a recording step and inputted into, for example, the color image forming apparatus serving as a recording unit d of the embodiment of FIG. 1.

When a color signal outputted from an image reading apparatus provided independent of the color image forming apparatus is inputted into the laser writing unit 7, a laser beam emitted from a semiconductor laser (not shown) is caused to rotationally scan by a polygon mirror 7B therein which is turned by a driving motor 7A, and the optical path of the laser beam is then bent by mirrors 7D, 7E via a $f\theta$ lens 7C, the laser beam being thereafter projected on the circumferential surface of the photosensitive belt 1 which has been charged by the charging device 6 provided as a charging means.

When the scanning is started, the laser beam is detected by an index sensor, and the modulation of the laser beam in accordance with a first color signal is started, the circumferential surface of the photosensitive belt 1 being scanned with the modulated laser beam. Thus, a latent image corresponding to a first color is formed on the circumferential surface of the photosensitive belt 1 by the primary scanning with the laser beam and the auxiliary scanning based on the movement of the photosensitive belt 1. This latent image is developed reversely in a non-contact state by the developing device 8 containing a yellow developer, among the developing means in this apparatus, to form a yellow toner image on the circumferential surface of the photosensitive belt 1. The toner image thus obtained passes under the cleaning unit 13 placed apart from the circumferential surface of the photosensitive belt 1, as the image is left on the same belt 1, to enter a subsequent copying cycle.

The photosensitive belt 1 is charged again by the charging device 6, and a second color signal outputted from the signal processor is then inputted into the writing unit 7, the writing on the circumferential surface of the photosensitive belt 1 being done in the same manner as in the case of the writing based on the first color signal, to form a latent image. This latent image is developed reversely in a non-contact state by the developing device 9 containing a magenta developer as a second color developer, to be turned into a magenta toner image superposed on the already-formed yellow toner image.

A reference numeral 10 denotes a developing device containing a cyan developer with which a cyan toner image is formed on the previously-mentioned toner images on the circumferential surface of the photosensitive belt 1 on the basis of an image signal generated in the signal processor.

A reference numeral 11 denotes a developing device containing a black developer, with which a black toner image is superposed on the already-formed toner images on the circumferential surface of the photosensitive belt 1 by the same process as mentioned above. A DC or AC bias voltage is applied to the sleeves in these developing devices 8, 9, 10 and 11, and a jumping developing is carried out with a developing means, i.e. a one-component or two-component developer, whereby the non-contact reverse development is carried out on the photosensitive belt 1 the base body of which is grounded.

The color toner image thus formed on the circumferential surface of the photosensitive belt 1 is transferred in the transfer unit on the transfer paper fed from the automatic paper feed unit or manual paper transfer unit.

The ordinary transfer paper stored in the paper feed cassette 14 or the thick transfer paper on the manual insertion table 30 is sent out piece by piece in accordance with the rotation of the paper feed roller 16 or paper feed rollers 31 toward the transfer unit, in which the transfer device 12 and charge eliminating bar 12A are provided, via the intermediate rollers 17 and synchronizing shutter 32 in synchronism with the image forming on the photosensitive belt 1.

The transfer paper which has been subjected to the transferring of an image and the elimination of charge is separated reliably from the photo-sensitive belt 1, the direction of movement of which is suddenly changed along the roller 2, to advance upward without being influenced, owing to the charge eliminating effect, by the scatter of the toner which causes the quality of the image to lower. The image is then fixed by the fixing rollers 18, and thereafter the transfer paper passing through the change-over blade 34 is then ejected from the ordinary paper ejection port 36 or thick paper ejection port 37, which suits the actual transfer paper, onto the ejection tray 20 via the paper ejection rollers 19 and ejection port change-over blade 34 which will be described later.

The photosensitive belt 1 which has finished transferring the image to the transfer paper continues to be moved to the cleaning device 13 in which the blade 13A facing the roller 3 and the rotating toner transfer roller 13B are brought into pressure contact with the photosensitive belt 1. In this cleaning device 13, the removing of the residual toner is done, and, after the completion of the removal of the toner, the blade 13A is separated from the photosensitive belt 1, the toner transfer roller 13B being separated a little later from the same belt 1 to enter into a new image forming process.

Figure 2:
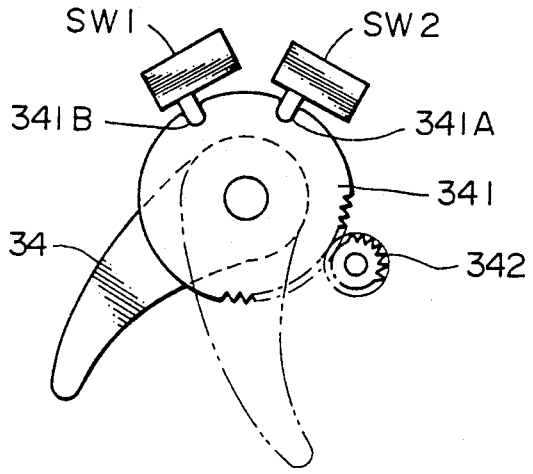
FIG. 2 is a side elevation of an example of a change-over blade for the discharge ports shown in FIG. 1.
Figure 3:
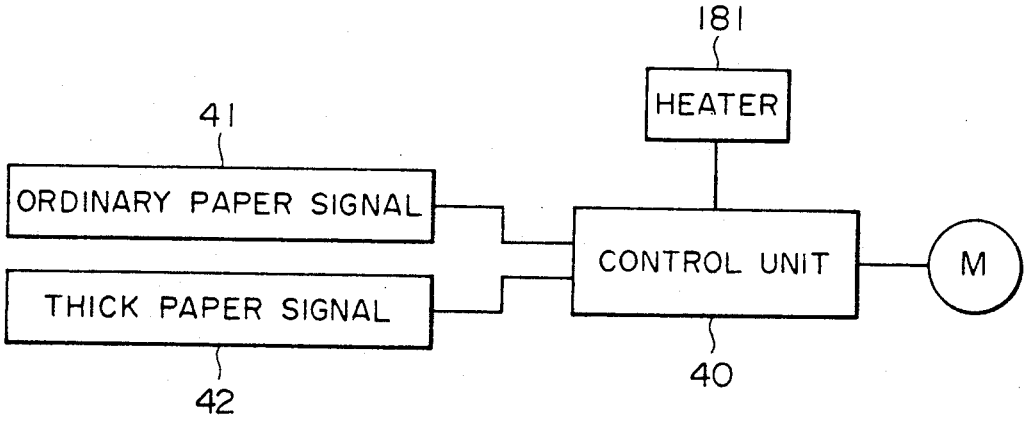
FIG. 3 is a block diagram showing a change-over control system for the change-over blade in the first embodiment.

The change-over blade 34 and the controlling of the same will now be described with reference to FIGS. 2 and 3. Referring to FIGS. 2 and 3, a reference numeral 341 denotes a driving wheel concentrically provided on one end portion of the change-over blade 34, 342 a pinion meshed with teeth formed on a part of the circumference of the driving wheel 341, reference symbols SW1, SW2 switches fixed to the apparatus body, a reference numeral 40 a control unit, 41 an ordinary paper signal sent to the control unit 40 when the paper feed roller 16 is turned, 42 a thick paper signal sent to the control unit 40 when the paper feed rolls 31 are turned, 181 a heater for the fixing rollers 18, and a reference letter M a change-over motor turned by a control operation of the control unit 40.

As described below, the change-over blade 34 is turned by the pinion 342 connected to the change-over motor M and can be switched to either a position shown by a solid line or a position shown by a two-dot chain line shown in FIG. 2.

The driving wheel 341 is provided in a part having no teeth with recesses 341A, 341B in which the actuators of the switches SW1, SW2 fixed to the apparatus body are fitted. The angular distance between these recesses 341A, 341B is set equal to the change-over angle of the change-over blade 34. The switches SW1, SW2 are turned on when their actuators engage the recesses 341A, 341B. Accordingly, the control unit can know the position of the change-over blade 34 in accordance with the ON, OFF signals from the switches SW1, SW2, as shown in Table 1 below.

TABLE 1

| Position of blade 34 | SW1 | SW2 |
|---|---|---|
| Position for passing ordinary paper | ON | ON |
| Position for passing thick paper | ON | OFF |

When a thick paper signal 42 is inputted into the control unit 40, the position of the change-over blade 34 is checked by the unit 40. When the change-over blade 34 is in the position for passing the ordinary paper, it is switched to the lower position for passing the thick paper, by controlling the change-over motor M. When an ordinary paper signal 41 is then inputted into the control unit 40, the change-over blade 34 is switched to the upper position for passing the ordinary paper.

Therefore, when ordinary transfer paper is supplied from the automatic paper feed unit via the paper feed roller 16 and subjected to a copying operation by the above mentioned process, the transfer paper on which the thermal fixing of a toner image has been finished is sent to the paper ejection port by the paper ejection rollers 19. Since the transfer paper is then guided by the change-over blade 34 to the ordinary paper ejection port 36 in a lower position, the direction of the transfer paper is largely changed, and the transfer paper is ejected properly from the ordinary paper ejection port 36 onto the ejection tray 20, with the copied surface of the transfer paper downward.

The thick paper which has been fed from the manual paper feed unit by the paper feed rollers 31 and subjected to the thermal fixing of a toner image is guided into the upper passage having a larger radius of curvature, and discharged properly from the thick paper discharge port 37 onto the ejection tray 20 without receiving an excessively large force.

In this case, the quantity of an electric current supplied to the heater 181 for the fixing rollers 18 is also controlled at the same time by the control unit 40. Namely, when the ordinary paper signal 41 is received, a quantity of electric current suitable for ordinary paper is applied; and, when the thick paper signal 42 is received, the temperature of the heater 181 is increased a little so as to raise the quantity of heat to be applied. Accordingly, the image fixing operation for both ordinary paper and thick paper can be carried out properly and reliably.

Second Embodiment

A second embodiment of the present invention will now be described. In the first embodiment, as described above, the ordinary paper signal 41 is sent to the control unit 40 in accordance with the rotation of the paper feed roller 16, and the thick paper signal 42 in accordance with the rotation of the paper feed rollers 31.

The second embodiment is provided with a paper thickness sensor for detecting the thickness of the transfer paper, on the manual insertion table 30 so that the ordinary transfer paper can be fed from the manual insertion table 30 as well. Namely, only when transfer paper of a thickness of not lower than a predetermined value is sent out by the paper feed rollers 31, the thick paper signal 42 is inputted into the control unit 40, and the thick transfer paper which has been subjected to the transferring and fixing of an image is ejected from the thick paper ejection port 37. In the case where ordinary transfer paper is sent out from the automatic paper feed unit by the paper feed roller 16, and, in the case where ordinary transfer paper is sent out from the manual paper feed unit by the paper feed rollers 31, the ordinary paper signal 41 is inputted into the control unit 40, and the ordinary transfer paper is subjected to the transferring and fixing of an image and then ejected from the ordinary paper ejection port 36. The control unit 40 controls the quantity of electric current to the heater 181 for the fixing rollers 18 in the same manner as in the first embodiment, so that a proper and reliable fixing operation is carried out at all times.

The thick transfer papers are generally made in special sizes, for example, of a postcard. It is necessary that the manual insertion table 30 is provided with guide plates adjusted in accordance with the width of transfer paper for the purpose of positioning the transfer paper thereon. Therefore, it is possible to install a paper size detecting means for detecting the use of transfer paper of special sizes in accordance with the positions in which the guide plates are set. A paper size detecting means can be provided instead of the paper thickness sensor to input the thick paper signal 42 into the control unit 40.

Since the second embodiment is completely identical with the first embodiment except that an ordinary paper signal 41 or a thick paper signal 42 is generated as mentioned above, the detailed description thereof is omitted.

The present invention described above is provided with two kinds of paper ejection ports for ordinary transfer material and thick transfer material, and an automatic paper feed unit containing ordinary transfer paper and a manual paper feed unit for inserting thick transfer material, both units being set below a developing means, and one of the paper ejection ports is selected in accordance with the paper feed unit selected, the quantity of heat supplied to the heater of the fixing rollers being also controlled in accordance with the paper feed unit selectively used. Accordingly, both the copied ordinary transfer material and copied thick transfer material are subjected to a fixing operation properly and reliably, and stacked on the same ejection tray properly with the copied surfaces facing in the same direction. Thus, a compact color image forming apparatus free from transfer material ejection troubles can be provided.

What is claimed is:

1. A color image forming apparatus comprising:

an image forming means comprising:

at least two rollers arranged laterally spaced apart;

a belt-shaped image retainer which is trained around said at least two rollers; and a plurality of developing means provided below said belt-shaped image retainer;

an automatic paper feed unit including means for holding a transverse material, said automatic paper feed unit being in parallel to said image forming means and provided directly below said image forming means;

paper guide means for forming a passage for transporting transfer material from said automatic paper feed unit, said paper guide means including a transfer portion where the transverse material is in contact with said belt-shaped image retainer at one of said at least two rollers, said paper guide means being arranged substantially vertical to said automatic paper feed unit so that the transfer material is transported in an upward direction;

paper ejection means for ejecting the transfer material sent from said paper guide means, said paper ejection means being provided at a position above said image forming means, and said paper ejection means including a plurality of transfer material ejection port means which are selectable according to a thickness of the transfer material;

an ejection tray, provided above said image forming means, in parallel to said image forming means, and arranged for receiving transfer material ejected from said plurality of transfer material ejection port means of said paper ejection means, said ejection ports means of said paper ejection means being arranged relative to said ejection tray such that an ejected transfer material from any of said ejection port means with an image formed thereon is ejected image-face-down on said ejection tray;

said transfer material ejection port means including a first ejection passage having a first radius of curvature, and a second ejection passage having a second radius of curvature, and wherein the first radius of curvature is larger than the second radius of curvature; and means including at least one of a thickness detecting means for detecting a thickness of a transfer material, and a thickness designating means for designating a thickness of a transfer material;

said transfer material being ejected from the first ejection passage whenever the transfer material is detected or designated to be a thick transfer material, and said transfer material being ejected from the second ejection passage whenever the transfer material is detected or designated to be a thin transfer material.

2. The apparatus of claim 1, further comprising thermal fixing means for varying a thermal fixing condition according to the transfer material thickness.

3. The apparatus of claim 1, wherein said transfer material ejection port means said paper ejection means are arranged such that a transfer material selectively ejected from any of said ejection ports of said paper ejection means is placed on said ejection tray.

4. The apparatus of claim 1, further comprising:

a manual paper feed means provided below said image forming means for enabling manually feeding in of a transfer material; and wherein said paper guide means comprises means defining a passage for transporting a transfer material from said automatic paper feed unit or from said manual paper feed means.

5. The apparatus of claim 2, wherein:

the apparatus comprises said thickness detecting means;

said thermal fixing means fixes an image on the transfer material; and said thermal fixing means further comprising means responsive to said thickness detecting means for controlling said thermal fixing means in accordance with the detected transfer material thickness.

6. The apparatus of claim 1, wherein said thickness detecting means includes means for selecting said one of said plurality of ejection port means as a function of the detected thickness of a transfer material.

7. The apparatus of claim 1, wherein the belt-shaped image retainer is arranged substantially horizontally.

8. The apparatus of claim 1, wherein a space is provided between said automatic paper feed unit and said image forming means, and another space is provided between said ejection tray and said image forming means.

* * * * *